US005360038A

United States Patent [19]

Sano

[11] Patent Number: 5,360,038

[45] Date of Patent: Nov. 1, 1994

[54] SEAM WEAVING METHOD USING A SHEDDING SYSTEM WITH PNEUMATICALLY OPERATED HEDDLES

[75] Inventor: Seiji Sano, Tokyo, Japan

[73] Assignee: Nippon Filcon Co., Ltd., Tokyo, Japan

[21] Appl. No.: 939,472

[22] Filed: Sep. 4, 1992

[30] Foreign Application Priority Data

Sep. 10, 1991 [JP] Japan ..... 3-307252

[51] Int. Cl.[5] ..... D03C 3/22

[52] U.S. Cl. ..... 139/383 AA; 139/55.1; 139/455; 139/456

[58] Field of Search ..... 139/55.1, 456, 455, 139/383 AA, 93; 28/141

[56] References Cited

U.S. PATENT DOCUMENTS 4,195,671 7/1978 Brochier .
4,410,015 10/1983 Koller et al. ..... 139/383 AA
4,985,970 1/1991 Krenkel et al. ..... 139/383 AA X

FOREIGN PATENT DOCUMENTS 1209442 8/1986 Canada .
477734 4/1992 European Pat. Off. .
2156069 5/1973 France .
2627514 8/1989 France .
2832515 2/1979 Germany .
2939421 1/1981 Germany .
1-292135 11/1989 Japan .
2043123 10/1980 United Kingdom .
80-00719 4/1980 WIPO .

*Primary Examiner*—Andrew M. Falik
*Attorney, Agent, or Firm*—Beveridge, DeGrandi, Weilacher & Young

[57] ABSTRACT

A shedding device and a method for joining the ends of a fabric into an endless belt of fabric, or, alternatively, joining the ends of separate pieces of fabric into a single piece of fabric. The shedding device employs a plurality of heddles supported at only one end, allowing the heddles to be individually moved or adjusted. The heddles are connected to the top ends of piston rods of a plurality of pneumatic cylinders. The heddles move up and down to shift threads passing through the heddles, so as to form a shed. The shedding method employs an interweaving piece of fabric, with a portion of the interweaving piece having only weft threads. The weft thread of the interweaving piece interwoven with the warp threads of the ends of the fabric to be joined. Alternatively, the weft threads of the interweaving piece can be interwoven with the weft threads of the ends of the fabric to be joined.

16 Claims, 4 Drawing Sheets

SEAM WEAVING METHOD USING A SHEDDING SYSTEM WITH PNEUMATICALLY OPERATED HEDDLES

INTRODUCTION AND BACKGROUND

The present invention relates to a system for forming the shed in a seam weaving portion for joining the ends of a fabric and to a method of forming a woven seam using the system.

As known in the art, the ends of a fabric are joined together to form an endless fabric or the peripheral edge of a fabric is joined to that of another fabric to form a larger piece of fabric. In most of the conventional methods, the ends of the fabric or the peripheral edges are overlapped with each other and then sewn together or bonded together.

However, the above-mentioned conventional method of joining together fabric can not be employed for papermaking fabrics, such as a sheet forming fabric. This is because such papermaking fabrics require a uniform structure and a uniform filtration space. Otherwise, the resultant paper product formed on the fabric is nonuniform in thickness and causes undesirable marking to occur.

In addition, fabrics for use in the manufacture of nonwoven fabrics must have a uniform structure in view of touch, laminatability and uniformity.

Further, the above-mentioned conventional method can not be used for fabrics which are for covering the sludge in a pressure dewatering process. This is because leakage of the sludge occurs due to the presence of the nonuniform filtering area in adjoining ends of a fabric which face each other. A method of alleviating this problem includes removing transversal or weft threads in one of the joining ends over a seam width to leave longitudinal or warp threads alone, introducing the warp threads into a fabric structure of the other joining end, and cutting and removing parallel warp threads of the other joining end. However, this method is not practically available unless the fabric is a coarse mesh.

In this connection, it has been considered to join the ends of a fabric by weaving, in adjoining portions, a fabric which is similar in structure to the main body of the fabric.

According to this prior method, threads which serve as warp threads corresponding to weft threads of the main body of the fabric are separated vertically upwardly to form the shed in a seam weaving portion. On the other hand, threads in both ends of the fabric to be joined are introduced into the shed as weft threads. Thus, a woven seam is formed. However, in order to effectively and mechanically perform the shed formation for weaving, there exists no other means superior to the known Jacquard device.

However, the Jacquard device generally requires longitudinal needles, transverse needles, knives, pattern cards, cylinders for receiving the pattern cards and inevitably has a large size. It is therefore inappropriate to use the Jacquard device in forming a woven seam which is narrow.

In sheet forming fabric, a wide variety of fabric structures are used and multi-layer fabrics have recently been put into use. In this connection, the number of heddles inevitably increases. This results in a further increase the size of the shedding system. Thus, such a conventional shedding system is not satisfactory for use in a seam weaving operation.

In addition, the Jacquard device has heddles each of which is supported at both upper and lower ends thereof and moved for the shed formation. With this structure, it is impossible to separately pick up an individual one of the heddles. When a large number of the heddles are arranged in a seam weaving portion which is narrow, it is difficult to thread the heddles surrounded by a mass of heddle supporting members standing together closely. If a thread is snapped during the seam weaving operation, it is extremely difficult to find the particular heddle in question and to thread the particular heddle for recovery.

In particular, the Jacquard device encounters difficulty in treating multi-layer fabrics, such as double-layer fabrics and triple-layer fabrics, which have recently been put into use.

As is known in the art the term "shed" means the path through and perpendicular to the warp in a loom. The shed is formed by raising some warp threads by means of their harness while others are left down. The shuttle press through the shed to insert the filling. The term "shedding" means the operation of forming a shed in the weaving process. Also as is known in the textile art, the heddle is a cord, round steel wire, or thin flat steel strip, or equivalent with a loop or eye near the center through which one or more warp threads pass on the loom so that their movement may be controlled in weaving. The heddles conventionally are held at both ends by the harness frame. They control the weave pattern and shed as the harnesses are raised and lowered during weaving.

As a result of a study to overcome the above-mentioned disadvantages, it was determined that a shedding system must be modified in order to improve the seam weaving speed and to form a woven seam of a wide variety of fabric structures.

SUMMARY OF THE INVENTION

According to this invention, it is an object to provide a shedding system with heddles supported at one end thereof, comprising a plurality of heddles supported at one ends individually coupled to top end and of piston rods of a plurality of pneumatic cylinders. The device of the invention also includes a control unit for producing a signal to operate the electromagnetic valves, the heddles being moved vertically upwardly and downwardly by stroke movement of the pneumatic cylinders to thereby form the shed in an array of threads individually passing through eyes of the heddles.

In a more detailed aspect, the shedding system of the invention also includes a cooling fan for cooling the electromagnetic valves and a control unit having a memory for memorizing a fabric structure.

Each of the heddles used in the present invention is a solid body formed of metal or plastics.

The heddles can be molded into a shape having an arcuate section or an undulating section. Any suitable metal or plastic having the properties necessary to perform this function can be used to make the heddle.

Another object of the invention is to provide a method of joining the ends of a fabric by a woven seam to form an endless fabric. In carrying out this method an interweaving piece is prepared which is made of the same kind of fabric as the fabric to be joined and which has a width corresponding to that of the woven seam and a length longer than the transverse width of the fabric to be joined. The interweaving piece has one longitudinal end area with a fabric structure left therein and a remaining area containing weft threads alone and with the warp threads removed therefrom. The weft threads are removed in both end zones of the fabric over a width substantially equal to that of the woven seam to form interweaving portions comprising warp threads alone. The interweaving portions are then held on a weaving table so that the interweaving portions face each other at a distance equal to the width of the woven seam so as to define a space therebetween. The interweaving piece is placed in the space so that the fabric structure left at the one longitudinal end area is positioned at one transverse ends of the interweaving portions. The weft threads of the interweaving piece are passed through eyes of a plurality of heddles, the heddles being supported at one end individually coupled to top ends of piston rods of a plurality of pneumatic cylinders. Weights are attached to other ends of the weft threads of the interweaving piece to apply tensile force to the weft threads.

Electromagnetic valves connected to the pneumatic cylinders are operated by a signal from a control unit, to move the heddles vertically upwardly and downwardly by stroke movement of the pneumatic cylinders to thereby form the shed in an array of the weft threads passing through the eyes of the heddles. The warp threads of the interweaving portions are introduced into the shed to thereby form the woven seam in accordance with the invention.

In another embodiment of the invention, the method of joining the ends of a fabric by a woven seam to form an endless fabric is the same as described above except that the warp threads, instead of the weft threads, of the interweaving piece are passed through eyes of the plurality of heddles. In all other respects, this second embodiment is the same as the first method described above.

According to a more detailed aspect of the invention, and in both method embodiments described above the threads of the interweaving portions to be introduced into the shed have a crimp similar to that of the original threads which are introduced into the shed when the fabric to be joined is initially woven.

Still further, the woven seam can be made to have a fabric structure similar to that of the other portion of the fabric by the use of a memory which is included in the control unit of the shedding system and which is for memorizing the fabric structure.

In yet another aspect of the invention, weighted strings are connected to the weft threads of the interweaving piece passing through the eyes of the heddles to apply tensile force to the weft threads during the weaving operation of the fabric structure.

BRIEF DESCRIPTION OF THE DRAWINGS

The present invention will be further understood with reference to the drawings, wherein.

DETAILED DESCRIPTION OF THE INVENTION

This invention is characterized in that the heddles are supported at one end thereof and are independent from one another. With this structure, it is possible to separately pick up a desired single one of the heddles among a mass of the heddles.

Accordingly, even if a large number of the heddles are arranged in a narrow limited area, the threading operation is not impeded by other heddles at all. In the case when a thread is snapped in operation of the weaving operation, recovery is readily performed because the particular heddle in question can be easily selected from the mass of heddles in the apparatus. Specifically, the heddles are swingable because they are supported at only one end thereof. Therefore, the mass of the heddles can be manually pushed aside to select the particular heddle in question for recovery. Alternatively, the particular heddle in question can be automatically protruded vertically upwardly or downwardly.

Figure 1:
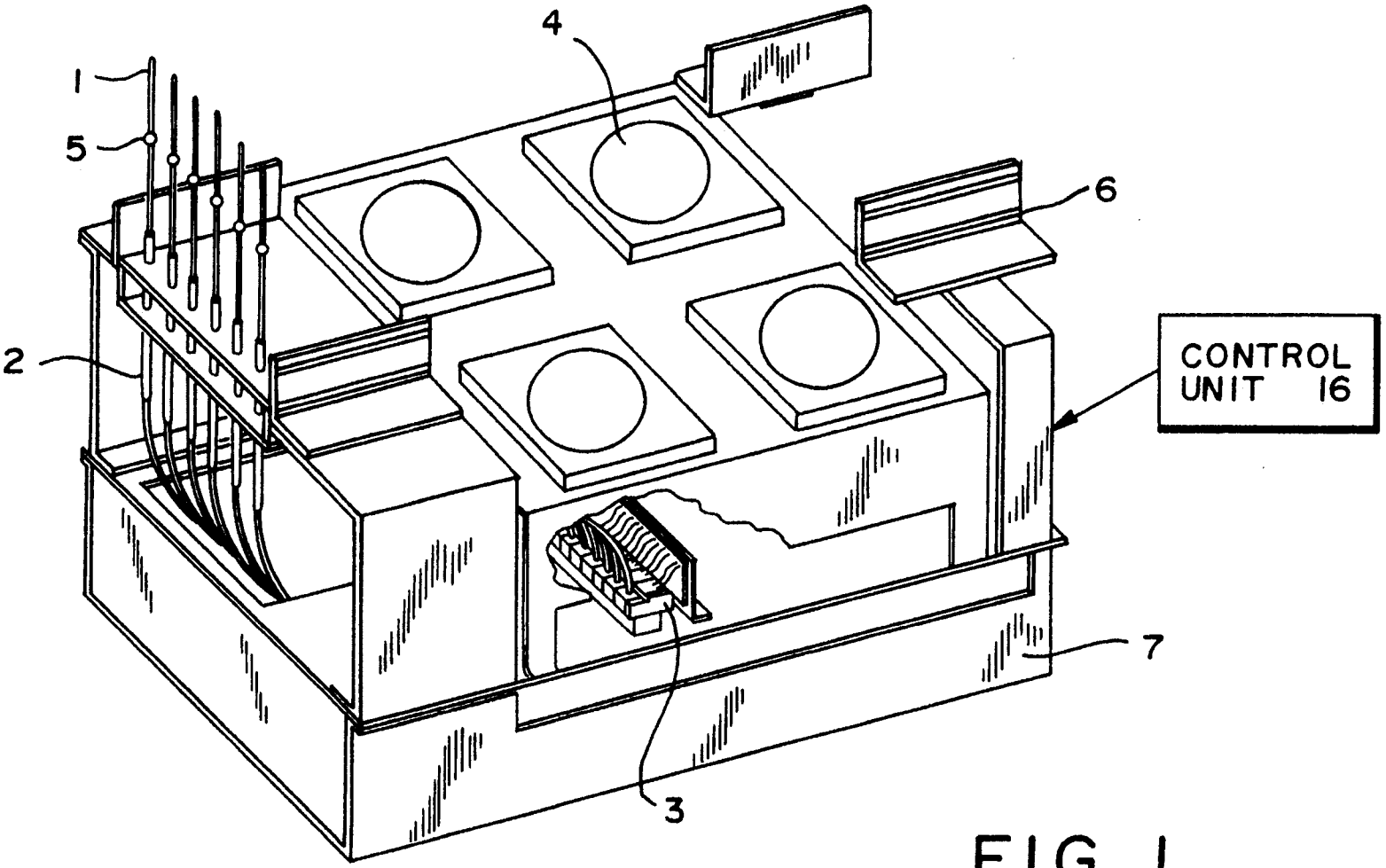
FIG. 1 is a perspective view of a shedding system of the invention.

FIG. 1 is a perspective view of a shedding system according to this invention. Each heddle 1 has an eye 5 and is connected to a piston rod 8 of each pneumatic cylinder 2, and the heddles 1 are positioned in the vicinity of an end of a case 7. However, the pneumatic cylinders 2 may be positioned at a center of the case. The case 7 may be a box or a frame.

The control unit 16 consists of a computer and a memory. The memory stores the data of fabric pattern or structure of the area to be shedded. The computer reads the prescribed data stored in the memory and produces the signals each of which designates each of magnetic valves 3 being opened or closed. The control unit 16 may be positioned inside or outside the case 7. Such a control unit is well known in the art, and any suitable control unit can be used for the purposes of the present invention.

The electromagnetic valves 3 are individually connected to the pneumatic cylinders and drive the pneumatic cylinders in response to a signal from the conventional control unit 16.

Cooling fans 4 are for removing heat generated by operation of the pneumatic cylinders. The cooling fans may be arranged at a side surface.

A mobile guide 6 is attached to the case. The case is mounted through the guide on a guide rail of a weaving table to be movable along the weaving table.

Figure 2:
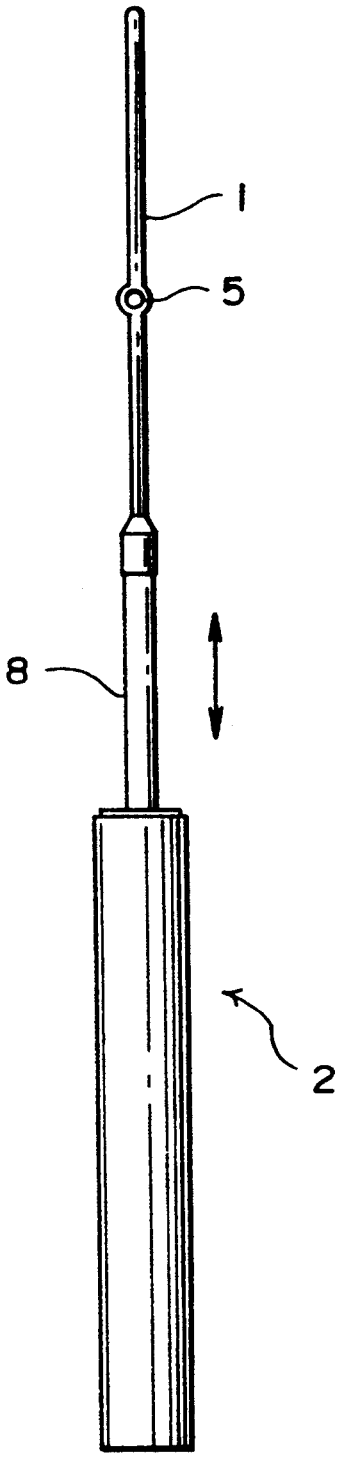
FIG. 2 is a schematic view of a pneumatic cylinder connected to the heddle.

FIG. 2 shows the pneumatic cylinder connected to the heddle. The heddle is coupled to a piston rod 8 of the pneumatic cylinder.

Figure 3:
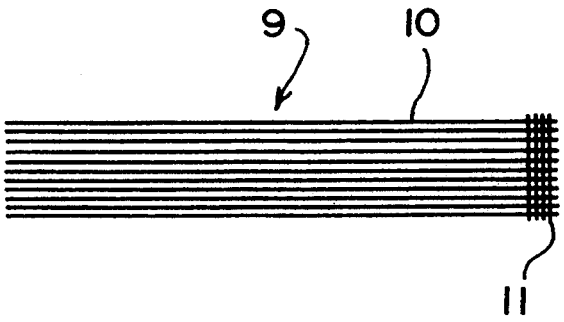
FIG. 3 is a schematic plan view of an interweaving piece.

FIG. 3 shows an interweaving piece 9. The interweaving piece has at one end thereof a fabric structure comprising weft threads 10 and warp threads 11. In a remaining portion of the interweaving piece all warp threads are removed to leave the weft threads 10 with a crimp. The interweaving piece has a width corresponding to that of a woven seam and a length longer than the transverse width of the fabric to be joined.

Figure 4:
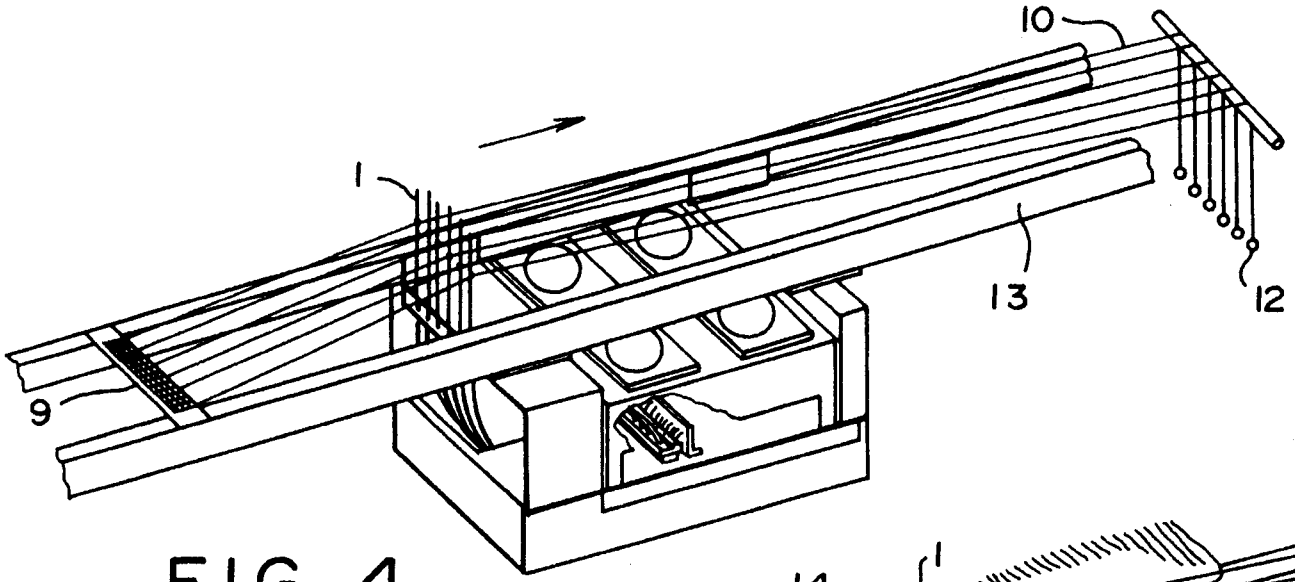
FIG. 4 is a partial perspective view of the weaving apparatus of the invention illustrating the interweaving piece held on a weaving table.

FIG. 4 shows the interweaving piece held on a weaving table 13. The fabric structure remaining in the interweaving piece is fixed to the weaving table. The weft threads with a crimp are extended through the eyes of the heddles and subjected to tensile force by weights 12 connected to one ends of the weft threads. The case 7 is mounted on the mobile guide rail of the weaving table.

Figure 5:
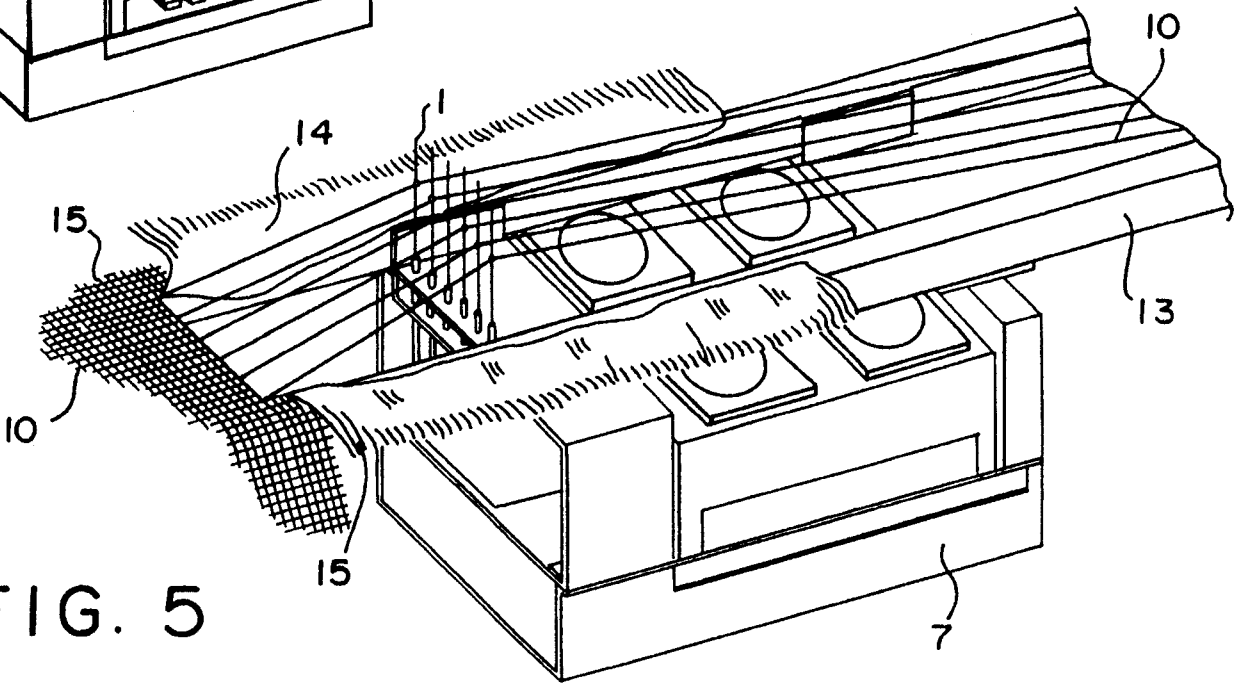
FIG. 5 is a partial perspective view of the weaving apparatus of the invention showing how the seam weaving method is carried out.

FIG. 5 is a view illustrating the seam weaving method according to this invention. In a seam weaving portion, end portions 14 of the fabric to be joined are arranged to face each other on the weaving table 13. The interweaving piece comprising the weft threads is placed between the end portions. The case 7 is mounted on the guide rail of the weaving table. The weft threads of the interweaving piece are made to pass through the eyes of the heddles.

The weft threads are removed from the end portions of the fabric to be joined over the width equal to that of the woven seam to leave the warp threads with a crimp.

When the heddles are moved by the pneumatic cylinders, the weft threads passing through the heddles are shifted to form the shed, like the warp threads in an ordinary weaving process. Like ordinary weft threads, the warp threads of the end portions of the fabric are successively introduced into the shed to form a fabric structure. At this time, the movement of the heddles is controlled so as to form the fabric structure similar to that of the main body of the fabric.

As is clear from a woven seam illustrated at the leftmost portion in FIG. 5, the weft threads 10 of the interweaving piece serve as the warp threads in the seam weaving operation while the warp threads 15 of the end portions of the fabric serve as the weft threads.

Figure 6:
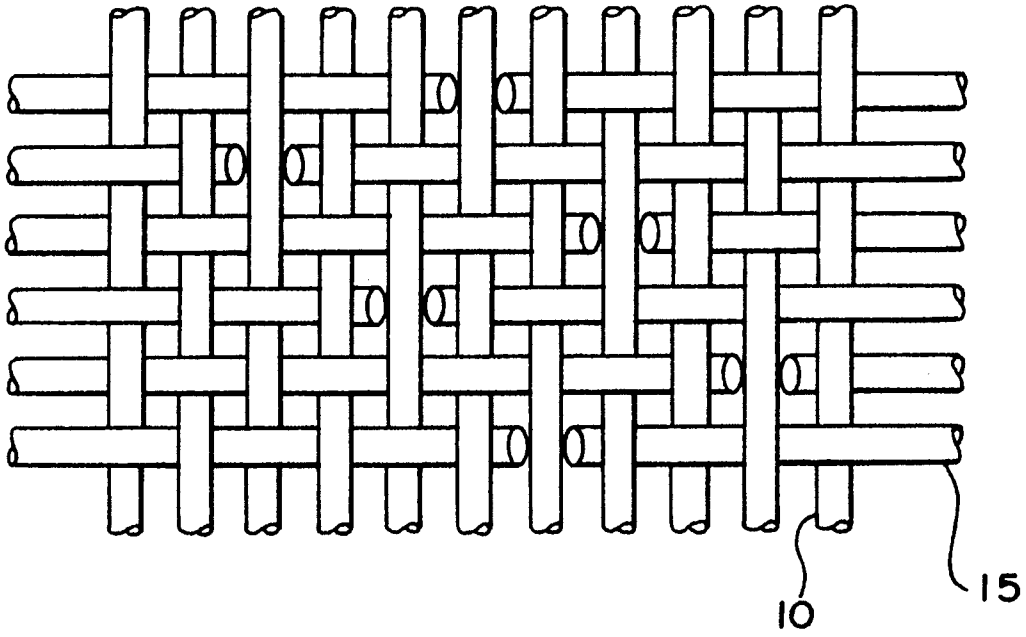
FIG. 6 is a plan view showing the top ends of warp threads interwoven according to the invention.

FIG. 6 shows the top ends of the warp threads which are interwoven. The top ends of the warp threads face each other with the weft threads interposed therebetween. The facing positions are dispersed to form no linear alignment. With this structure, any problems of marking are prevented.

Thus, a fabric structure completely similar to that of the main body of the fabric is formed.

In the conventional Jacquard device, the heddles are supported at both upper and lower ends thereof. Accordingly, the heddles can not be manually pushed aside. On the other hand, it is possible to make a particular heddle be upwardly protruded among a mass of the heddles. However, the particular heddle is not swingable because it is supported at both upper and lower ends. Furthermore, the supporting members of the other heddles closely stand and surround the particular heddle. As a result, threading or recovery operation is extremely difficult. Thus, in the Jacquard device, it is impossible to arrange a concentrated mass of the individual heddles in a narrow area.

The following describes the seam weaving method according to this invention.

At both ends of a fabric to be joined the weft threads are removed from end zones over a predetermined width to prepare interweaving portions exclusively comprising warp threads with a crimp. The interweaving portions with the warp threads alone are folded back and placed on a weaving table to face each other with a predetermined distance left therebetween.

An interweaving piece is made of the same kind of fabric as the fabric to be joined and has a width corresponding to that of a woven seam and a length longer than the transverse width of the fabric to be joined. The interweaving piece has a fabric structure at one end thereof with warp threads retained therein while a remaining area of the interweaving piece contains only weft threads with a crimp with warp threads removed therefrom. The interweaving piece is fixedly located in a space defined between the interweaving portions facing each other so that the one end with the fabric structure is positioned at a seam weaving starting side and the weft threads are parallel to the weaving table. The weft threads of the interweaving piece are made to pass through the eyes of the heddles. The weft threads are subjected to tensile force which is produced by weights attached to one end of the weft threads.

The heddles are individually connected to pneumatic cylinders. The heddles are supported at one ends coupled to the top end and of piston rods of the pneumatic cylinders. Electromagnetic valves of the pneumatic cylinders are operated in response to a signal delivered from a control unit to move the heddles vertically upwardly and downwardly. Consequently, the weft threads of the interweaving piece passing through the heddles are shifted vertically upwardly and downwardly to form the shed. The warp threads of both end portions of the fabric to be joined are introduced into the shed. Thus, seam weaving operation is carried out to integrally join the both end portions by forming a fabric. As described, a woven seam has a structure similar to the other portion of the fabric.

In this seam weaving operation, the weft threads of the interweaving piece are shifted by heddles to form the shed while the warp threads of the main body of the fabric are introduced into the shed. In comparison, when the original fabric is woven, the warp threads are shifted by heddles to form the shed while the weft threads are introduced into the shed.

In the foregoing description, the interweaving piece is prepared by removing the warp thread to leave the weft threads alone. Alternatively, seam weaving operation can also be carried out with the interweaving piece prepared by removing the warp threads to leave the weft threads alone. In this case, the warp threads are removed from the both ends of the fabric to be joined over the width corresponding to that of the woven seam to form the interweaving portion comprising the weft threads alone.

Use may also be made of a combination of an interweaving piece prepared by the weft threads alone and interweaving portions formed by the warp threads alone.

Since the fabric is formed by warp threads and weft threads, the seam weaving operation can be carried out whichever thread is introduced into the shed.

The pneumatic cylinders to be used have a diameter between 2.5 mm-5 mm.

The pneumatic cylinders are driven by electromagnetic valves which are operated in response to a signal from a control unit having a memory for memorizing a structure of a woven seam.

Since heat is generated during the operation of the pneumatic cylinder, it is preferable to provide a cooling device such as a fan.

EXAMPLE 1

The system in FIG. 1 according to this invention was used to join the fabric consisting of single warp threads and double weft threads as shown in Table 1. A woven seam was formed at a rate of 150 mm per hour.

As compared with a conventional manual seam weaving in which a woven seam was formed at a rate of 60 mm per hour, the efficiency is almost three time high.

TABLE 1

| | | |
|---|---|---|
| Warp Thread | Diameter (mm) | 0.62 |
| | Number (per inch) | 45 |
| Upper Weft Thread | Diameter (mm) | 0.58 |
| | Number (per inch) | 16 |
| Lower Weft Thread | Diameter (mm) | 0.58 |
| | Number (per inch) | 16 |

In the shedding system according to this invention, the heddles are connected in a one-to-one correspondence to the pneumatic cylinders and are moved thereby. Since the pneumatic cylinders are very small, a large number of the pneumatic cylinders can be arranged in a seam weaving portion which is narrow. The pneumatic cylinders are driven by electromagnetic valves to cause stroke movement. Accordingly, the shedding system is very compact and can be arranged in the upper or the lower portion of the seam weaving portion.

According to this invention, the heddles are supported at one end thereof so that shedding system for seam weaving operation is small-sized and recovery of a thread snapping accident is facilitated. It is possible to readily and accurately form a woven seam having a desired structure.

Further variations and modifications of the invention will be apparent to those skilled in the art from the foregoing and are intended to be encompassed by the claims appended hereto.

I claim:

1. A method of joining ends of a fabric by a woven seam to form an endless fabric, comprising:

(a) preparing an interweaving piece made of the same kind of fabric as said fabric to be joined, and which has an interweaving width corresponding to a woven seam width of a woven seam for joining ends of said fabric, and a length longer than a transverse width of said fabric to be joined, said interweaving piece having a longitudinal end area with a fabric structure and a remaining area containing weft threads alone having warp threads removed therefrom, (b) removing weft threads in end zones of said fabric over a width substantially equal to said woven seam width to form interweaving portions made up of warp threads alone, (c) holding said interweaving portions on a weaving table so that said interweaving portions face each other at a distance equal to said woven seam width, so as to define a space therebetween, and placing said interweaving piece in said space so that said longitudinal end area of said interweaving piece is positioned along a transverse end of each of said interweaving portions, (d) causing said weft threads of said interweaving piece to pass through eyes of a plurality of heddles, said heddles being supported at an end and being individually coupled to top ends of piston rods of a plurality of pneumatic cylinders, (e) attaching weights to ends of said weft threads of said interweaving piece which are opposite said longitudinal end area, so as to apply tensile force to said weft threads, (f) operating electromagnetic valves connected to said pneumatic cylinders by a signal from a control unit, (g) moving said heddles vertically upwardly and downwardly by stroke movement of said pneumatic cylinders so as to form a shed in an array of said weft threads passing through said eyes of said heddles, and (h) introducing said warp threads of said interweaving portions into the shed to form said woven seam.

2. The method of joining the ends of a fabric by a woven seam to form endless fabric as claimed in claim 1 wherein the threads of said interweaving portions to be introduced into the shed have a crimp similar to that of the original threads which are introduced into the shed when said fabric to be joined is initially woven.

3. The method of joining the ends of a fabric by a woven seam to form an endless fabric as claimed in claim 1 wherein said woven seam is made to have a fabric structure similar to that of the other portion of said fabric by the use of a memory which is included in said control unit and which is for memorizing said fabric structure.

4. The method of joining the ends of a fabric by a woven seam to form an endless fabric as claimed in claim 1 wherein weighted strings are connected to said weft threads of said interweaving piece passing through said eyes of said heddles so as to apply tensile force to said weft threads during the weaving operation of said fabric structure.

5. A method of joining the ends of a fabric by a woven seam to form an endless fabric, comprising:

(a) preparing an interweaving piece made of the same kind of fabric as said fabric to be joined, and which has an interweaving width corresponding to a woven seam width of a woven seam for joining said fabric, and a length longer than a transverse width of said fabric to be joined, said interweaving piece having a longitudinal end area with a fabric structure and a remaining area containing warp threads alone having weft threads removed therefrom, (b) removing warp threads in end zones of said fabric over a width substantially equal to said woven seam width to form interweaving portions having weft threads alone, (c) holding said interweaving portions on a weaving table so that said interweaving portions face each other at a distance equal to said woven seam width, so as to define a space therebetween, and placing said interweaving piece in said space so that said longitudinal end area of said of said interweaving piece is positioned along a transverse end of each of said interweaving portions, (d) causing said warp threads of said interweaving piece to pass through eyes of a plurality of heddles, said heddles being supported at an end and being individually coupled to top ends of piston rods of a plurality of pneumatic cylinders, (e) attaching weights to ends of said warp threads of said interweaving piece which are opposite said longitudinal end area, so as to apply tensile force to said warp threads, (f) operating electromagnetic valves connected to said pneumatic cylinders by a signal from a control unit, (g) moving said heddles vertically upwardly and downwardly by stroke movement of said pneumatic cylinders so as to form a shed in an array of said waft threads passing through said eyes of said heddles, and (h) introducing said weft threads of said interweaving portions into the shed to form said woven seam.

6. The method of joining the ends of a fabric by a woven seam to form endless fabric as claimed in claim 5 wherein the threads of said interweaving portions to be introduced into the shed have a crimp similar to that of the original threads which are introduced into the shed when said fabric to be joined is initially woven.

7. The method of joining the ends of a fabric by a woven seam to form an endless fabric as claimed in claim 5 wherein said woven seam is made to have a fabric structure similar to that of the other portion of said fabric by the use of a memory which is included in said control unit and which is for memorizing said fabric structure.

8. The method of joining the ends of a fabric by a woven seam to form an endless fabric as claimed in claim 5 wherein weighted strings are connected to said warp threads of said interweaving piece passing through said eyes of said heddles so as to apply tensile force to said warp threads during the weaving operation of said fabric structure.

9. A method of joining ends of two fabric pieces by a woven seam to form a single piece, comprising:

(a) preparing an interweaving piece made of the same kind of fabric as at least one of said fabric pieces to be joined, and which has an interweaving width corresponding to a woven seam width of a woven seam for joining ends of said fabric pieces, and a length longer than a transverse width of each of said fabric pieces to be joined, said interweaving piece having a longitudinal end area with a fabric structure and a remaining area containing weft threads alone having warp threads removed therefrom, (b) removing warp threads in an end zone of each of said fabric pieces over a width substantially equal to said woven seam width to form interweaving portions made up of warp threads alone, (c) holding said interweaving portions on a weaving table so that said interweaving portions face each other at a distance equal to said woven seam width, so as to define a space therebetween, and placing said interweaving piece in said space so that said longitudinal end area of said interweaving piece is positioned along a transverse end of each of said interweaving portions, (d) causing said weft threads of said interweaving piece to pass through eyes of a plurality of heddles, said heddles being supported at an end and being individually coupled to top ends of piston rods of a plurality of pneumatic cylinders, (e) attaching weights to ends of said weft threads of said interweaving piece which are opposite said longitudinal end area, so as to apply tensile force to said weft threads, (f) operating electromagnetic valves connected to said pneumatic cylinders by a signal from a control unit, (g) moving said heddles vertically upwardly and downwardly by stroke movement of said pneumatic cylinders so as to form a shed in an array of said weft threads passing through said eyes of said heddles, and (h) introducing said warp threads of said interweaving portions into the shed to form said woven seam.

10. The method of joining the ends of fabric pieces by a woven seam to form a single fabric piece as claimed in claim 9 wherein the threads of said interweaving portions to be introduced into the shed have a crimp similar to that of the original threads which are introduced into the shed when at least one of said fabric pieces to be joined is initially woven.

11. The method of joining the ends of fabric pieces by a woven seam to form a single fabric piece as claimed in claim 9 wherein said woven seam is made to have a fabric structure similar to that of a portion of at least one of said fabric pieces by the use of a memory which is included in said control unit and which is for memorizing said fabric structure.

12. The method of joining the ends of fabric pieces by a woven seam to form a single fabric piece as claimed in claim 9, wherein weighted strings are connected to said weft threads of said interweaving piece passing through said eyes of said heddles so as to apply tensile force to said weft threads during the weaving operation of said fabric structure.

13. A method of joining the ends of fabric pieces by a woven seam to form a single fabric piece, comprising:

(a) preparing an interweaving piece made of the same kind of fabric as at least one of said fabric pieces to be joined, and which has an interweaving width corresponding to a woven seam width of a woven seam for joining said fabric pieces, and a length longer than a transverse width of each of said fabric pieces to be joined, said interweaving piece having a longitudinal end area with a fabric structure and a remaining area containing warp threads alone having weft threads removed therefrom, (b) removing warp threads in an end zone of each of said fabric pieces over a width substantially equal to said woven seam width to form interweaving portions having weft threads alone, (c) holding said interweaving portions on a weaving table so that said interweaving portions face each other at a distance equal to said woven seam width, so as to define a space therebetween, and placing said interweaving piece in said space so that said longitudinal end area of said of said interweaving piece is positioned along a transverse end of each of said interweaving portions, (d) causing said warp threads of said interweaving piece to pass through eyes of a plurality of heddles, said heddles being supported at an end and being individually coupled to top ends of piston rods of a plurality of pneumatic cylinders, (e) attaching weights to ends of said warp threads of said interweaving piece which are opposite said longitudinal end area, so as to apply tensile force to said warp threads, (f) operating electromagnetic valves connected to said pneumatic cylinders by a signal from a control unit, (g) moving said heddles vertically upwardly and downwardly by stroke movement of said pneumatic cylinders so as to form a shed in an array of said warp threads passing through said eyes of said heddles, and (h) introducing said weft threads of said interweaving portions into the shed to form said woven seam.

14. The method of joining the ends of fabric pieces by a woven seam to form a single fabric piece as claimed in claim 13 wherein the threads of said interweaving portions to be introduced into the shed have a crimp similar to that of the original threads which are introduced into the shed when at least one of said fabric pieces to be joined is initially woven.

15. The method of joining the ends of fabric pieces by a woven seam to form a single fabric piece as claimed in claim 13 wherein said woven seam is made to have a fabric structure similar to that of a portion of at least one of said fabric pieces by the use of a memory which is included in said control unit and which is for memorizing said fabric structure.

16. The method of joining the ends of fabric pieces by a woven seam to form a single fabric piece as claimed in claim 13, wherein weighted strings are connected to said warp threads of said interweaving piece passing through said eyes of said heddles to apply tensile force to said warp threads during the weaving operation of said fabric structure.

* * * * *